United States Patent [19]

Coch et al.

[11] Patent Number: 4,880,132

[45] Date of Patent: Nov. 14, 1989

[54] PROCESS FOR PLATING ADHERENT CO-DEPOSIT OF ALUMINUM, ZINC, AND TIN ONTO METALLIC SUBSTRATES, AND APPARATUS

[75] Inventors: Lester G. Coch, Northport; Arnold Satow, Bayside, both of N.Y.

[73] Assignee: McGean-Rohco, Inc., Cleveland, Ohio

[21] Appl. No.: 219,604

[22] Filed: Jul. 15, 1988

[51] Int. Cl.[4] ..... B65D 6/10

[52] U.S. Cl. ..... 220/83; 427/242; 118/418

[58] Field of Search ..... 220/83, 5 A, 72; 427/242; 118/418

[56] References Cited

U.S. PATENT DOCUMENTS

| | | | |
|---|---|---|---|
| 3,443,715 | 5/1969 | Edwards | 220/83 |
| 3,557,827 | 1/1971 | Marsh | 220/83 |
| 4,359,167 | 11/1982 | Fouss et al. | 220/83 |

*Primary Examiner*—A. Michael Chambers

*Attorney, Agent, or Firm*—Renner, Otto, Boisselle & Sklar

[57] ABSTRACT

A co-deposit of aluminum, zinc and tin can be deposited onto metallic substrates including small metal parts, and the co-deposit is strongly adherent to the substrate and exhibits improved corrosion resistant properties. The co-deposits are plated onto metallic substrates by a process which comprises the steps of a. preparing the substrate to receive the co-deposit, b. forming a slurry comprising a soluble source of stannous ions, impact media, and aluminum and zinc in particulate form in a liquid medium maintained at a pH below about 4, c. mechanically impacting the slurry against the surface of the metallic substrate in a plating container to plate a co-deposit of tin, aluminum and zinc on a metal surface, d. renewing the stannous ions, aluminum and zinc in the slurry while maintaining the pH of the slurry below about 4 throughout the plating process until a co-deposit of the desired thickness is obtained. The invention also includes metallic substrates plated with the co-deposit of aluminum, zinc, and tin in accordance with the process of the present invention as well as slurry compositions which are useful in plating such co-deposits on metal substrates. The invention also includes metal fasteners plated with said co-deposits in contact with aluminum articles to be fastened. An improved apparatus also is described and claimed for carrying out the process of the invention.

5 Claims, 1 Drawing Sheet

PROCESS FOR PLATING ADHERENT CO-DEPOSIT OF ALUMINUM, ZINC, AND TIN ONTO METALLIC SUBSTRATES, AND APPARATUS

TECHNICAL FIELD

This invention relates to a process for plating metallic surfaces with a zinc/tin/aluminum co-deposit. The co-deposits provide improved corrosion protection, and the adhesion of the co-deposit to the metallic substrate also is improved. The invention also relates to an improved apparatus for effecting the plating of the co-deposit on metal substrates, particularly small metal parts.

BACKGROUND OF THE INVENTION

The coating of wrought, cast and forged metal parts particularly ferrous parts, with sacrificial metals to provide atmospheric corrosion protection is a common practice in industry. Both the coating metal to be used and its thickness are dependent on the anticipated exposure conditions, pollution inhibitions, and cost restrictions. These coatings may be applied by various techniques known in the art including electroplating, mechanical plating, vacuum coating, or hot-dip galvanizing. Each method has advantages and disadvantages depending on the application, and thus the particular method chosen by one skilled in the art will depend on the particular applications and the desired results. Vacuum coating is expensive and is used for metals which are difficult to deposit. Electroplating and mechanical plating can be used to coat with several metals, while hot-dip galvanizing is limited to zinc coatings, all at a low cost. Mechanical plating and hot-dip galvanizing can apply thick coatings for greatly extended corrosion protection.

Many of the metal parts to be coated are ferrous parts made of high carbon steel which have their strength improved by various heat treating and/or work hardening processes. Such parts usually require cleaning in strong acids, commonly having dissociation constants of at least $10^{-3}$. In these processes, hydrogen is generated and absorbed by the parts, creating the possibility of hydrogen embrittlement. Mechanical plating, with its somewhat porous coating which permits rapid and spontaneous outgassing, virtually eliminates the possibility of hydrogen embrittlement, even with coatings as thick as 0.003 inches. No post plating heat treating for stress relief is required. A mechanical coating that is thin (as in electroplating) but providing the corrosion protection of thick hot-dip galvanizing would be advantageous since it would also avoid the problem of hydrogen embrittlement.

A practical limitation of the above coating systems has been the limitation of choices of metals that can be coated. Cadmium, which can be deposited by both electroplating and mechanical plating commercially is increasingly limited by pollution constraints. Zinc, which can be deposited by all three coating systems, is good in protecting against "red" rust when deposited in sufficient thickness, but in comparatively thin coatings, (e.g., 0.002 to 0.003 inches), zinc requires a post-plating chromate dip for extended corrosion resistance, another pollution hazard. Mechanical plating has had some success in co-depositing metals for additional coating utility, notably zinc/cadmium and tin/cadmium. Neither technique has eliminated the presence of cadmium.

It is common practice in mechanical plating to deposit a tin flash on the part to be coated by adding a, metal to a solution of a tin salt during the plating process such that the tin is galvanically reduced to tin metal. The common metals for this procedure are zinc, when zinc plating, or cadmium, when cadmium plating. This metal is called the driving metal. Golben has suggested in U.S. Pat. No. 3,400,012 that aluminum is suitable as a driving metal to produce the required tin flash. Coch has suggested in U.S. Pat. No. 4,654,230 that mechanical plating of aluminum alone can be improved by using pre-shaped aluminum particles. However, aluminum by itself proved a less than desirable coating in terms of corrosion resistance and physical properties.

Energy generation during mechanical plating processes is largely achieved by a combination of plating barrel design and speed of rotation. Barrels for mechanical plating are generally designed with six (or eight) sides to achieve a "bumping" or "throwing" motion. The energy generation achieved by plating barrel design is measured in surface feet/minute, and the surface feet/minute can be calculated for a given barrel as follows: Surface ft/min.=barrel major diameter (ft) x R.P.M.x3.1416 Surface speeds of 130–180 feet per minute suffice for virtually all parts when plating cadmium, tin or zinc.

SUMMARY OF THE INVENTION

It now has been found that a co-deposit of aluminum, zinc and tin can be deposited onto metallic substrates including small metal parts, and the co-deposit is strongly adherent to the substrate and exhibits improved corrosion resistant properties. The co-deposits are plated onto metallic substrates by a process which comprises the steps of a. preparing the substrate to receive the co-deposit,
b. forming a slurry comprising a soluble source of stannous ions, impact media, and aluminum and zinc in particulate form in a liquid medium maintained at a pH below about 4,
c. mechanically impacting the slurry against the surface of the metallic substrate in a plating container to plate a co-deposit of tin, aluminum and zinc on a metal surface,
d. renewing the stannous ions, aluminum and zinc in the slurry while maintaining the pH of the slurry below about 4 throughout the plating process until a co-deposit of the desired thickness is obtained.

The invention also includes metallic substrates plated with the co-deposit of aluminum, zinc, and tin in accordance with the process of the present invention as well as slurry compositions which are useful in plating such co-deposits on metal substrates. The invention also includes metal fasteners plated with said co-deposits in contact with aluminum articles to be fastened. An improved apparatus also is described and claimed for carrying out the process of the invention.

BRIEF DESCRIPTIONS OF THE DRAWINGS

In the annexed drawings like references depict like parts and features:

DETAILED DESCRIPTION OF THE INVENTION

Figure 1:
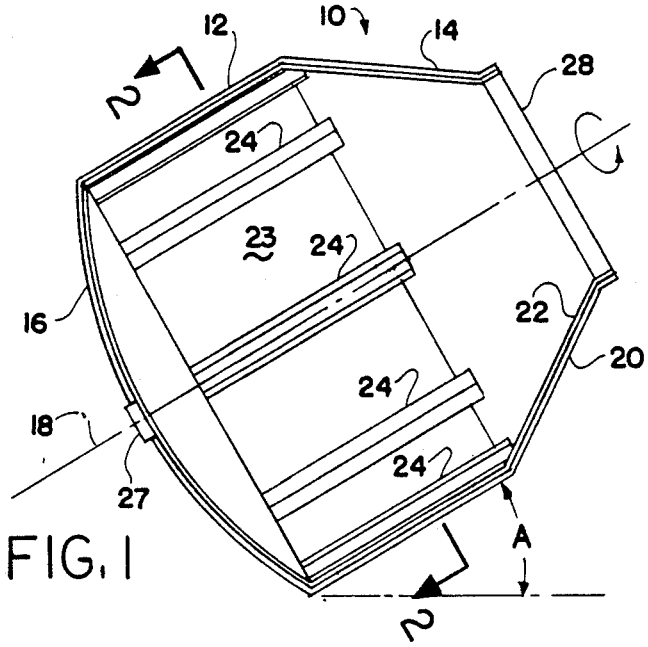
FIG. 1 is a cross-sectioned side elevational view of a plating barrel embodying the present invention in a particular form.

The present invention provides a simple method and materials by which mechanical plating processes can be adapted to plate a co-deposit of zinc, aluminum and tin that has corrosion resistant properties superior to those of zinc or cadmium coatings, and adhesion-cohesion properties superior to those generally associated with mechanical plating. The invention includes the discovery that if stannous ion is added to the plating slurry along with aluminum and zinc as driving metals as the plating proceeds, aluminum is co-deposited with a practical efficiency. If stannous salt is not added to the slurry but only aluminum and zinc, aluminum does not co-deposit with the zinc.

In one embodiment, the process of the present invention comprises the steps of:

a. preparing the substrate to receive the co-deposit,
b. forming a slurry comprising a soluble source of stannous ions, impact media, and aluminum and zinc in particulate form in a liquid medium maintained at a pH below about 4,
c. mechanically impacting the slurry against the surface of the metallic substrate in a plating container to plate a co-deposit of tin, aluminum and zinc on a metal surface, and
d. renewing the stannous ions, aluminum and zinc in the slurry while maintaining the pH of the slurry below about 4 throughout the plating process until a co-deposit of the desired thickness is obtained.

Step (d) may be repeated several times as necessary until a co-deposit of the desired thickness is obtained. In another embodiment, the co-deposit of zinc, aluminum and tin is applied as a flash coat which is then top coated with zinc. Thus in this embodiment, step (d) in the above embodiment is not repeated and the slurry is renewed with zinc powder alone or renewed with zinc and aluminum powder only.

The metallic substrates which can be treated in accordance with the process of the present invention include hardened steel, mild steel, stainless steel, ferrous powder metallurgy parts, and malleable cast iron. The process of the present invention is particularly useful in improving the corrosion- inhibition properties of small metal parts such as nuts, bolts, screws, nails, fish hooks, doorknobs, locks, hinges, and other subassemblies which otherwise are particularly difficult to treat because of the difficulty of coating the more inaccessible areas of these parts such as the grooves between the threads.

The first step in the process of the present invention is the preparation of the metallic substrate to receive the codeposit. Generally, the metallic substrate to be plated should be degreased and cleaned. Degreasing may be accomplished with organic solvents or alkaline compounds. Cleaning generally involves the use of a strong acid such as sulfuric acid. The acidic cleaning solution may contain inhibitors to prevent attack on the base metal. The metal substrate is flooded with the aqueous acidic solution, generally containing sufficient acid to lower the pH to 4 or less until the parts are essentially clean and free from oil and scale. When the metal substrates to be plated are small metal parts, the metal parts may be placed in the plating container and cleaned within the container. For example, when the plating container is a rotatable barrel, the metal parts can be placed within the metal barrel along with the aqueous acidic solution, and the parts are tumbled within the rotating barrel until the parts are substantially clean.

Preparation of the substrate to receive the co-deposit also may include a layer of copper on the substrates by any of the techniques known to those skilled in the art. A thin first flash plate of copper can be applied to the metallic substrate by displacement and/or galvanomechanical techniques. In the latter technique, small amounts of a soluble salt of copper such as copper sulfate ar added to the acid solution after the metallic substrate has been cleaned. In addition to the copper salts, other materials may be added to the acid solution such as surfactants and, as mentioned above, corrosion inhibitors, although such materials are not required to obtain satisfactory copper plating. After the copper salt have been added to the acid solution, the contents of the container are agitated such as by rotating the container to obtain a tumbling action, and this tumbling action is continued until the desired amount of copper plate has been deposited on the metallic substrate. Although the application of the copper flash plate to the metallic substrate prior to the deposition of the co-deposit of aluminum, zinc and tin is not essential, the presence of such copper plate generally results in a further improvement of the adhesion-cohesion of the co-deposit and an improvement of the corrosion-inhibiting properties of the co-deposit.

The desired co-deposit of aluminum, zinc and tin is obtained through the us of a slurry which comprises a soluble stannous salt, impact media, and aluminum and zinc in particulate form dispersed in a liquid medium maintained at pH below about 4. The liquid medium generally and preferably is water. Other liquids which may be utilized include isopropyl alcohol. The liquid medium typically is present in an amount of from 0.4 to about 20, more preferably from about 1 to 3.5 times the volume of the metal article to the plated.

The stannous salts which are incorporated into the slurries utilized in the process of the present invention are those salts which are soluble or partially soluble in the liquid medium at a pH of less than about 4. The preferred tin salts are the stannous salts because they are easier to reduce to the metal galvanically than the stannic salts. Examples of useful stannous salts include stannous chloride and its hydrates, stannous sulphates and its hydrates, and stannous oxide. Mixtures of one or more of the stannous salts can be used.

The slurries utilized in the process of the present invention also will contain aluminum and zinc, generally in particulate form. Preferably both the aluminum and the zinc will be present in the slurry as powders with the particle sizes ranging from about 3 microns to about 90 microns. The preferred particle sizes will depend upon the type and shape of the metallic substrate to be plated, and the choice can be readily made by those skilled in the art.

In some instances, pre-shaped aluminum or zinc particles can be employed as suggested in U.S. Pat. No. 4,654,230 (Coch). In the '230 patent a procedure is described wherein impact plating of selected metal powders onto metallic articles is improved by employing non-spherical particles which are characterized by an elongated, irregular surface which may contain at least one concave portion.

The aluminum and zinc powders which are present in the slurries utilized in the present invention often are described in the art of impact plating as driving metals. In the present invention both the aluminum and the zinc are also plating metals since they are co-deposited with the tin on the surface of the metallic substrate.

The slurries utilized in the present invention also include impact media. By "impact media" is meant a matrix material consisting of a mass of discrete solid granules usually much smaller than the articles or objects to be plated, but much larger than the metal powder particles (i.e. aluminum and zinc powder particles). The impact media also generally is inert to the particular chemical environment employed and is effective in separating and suspending the metal particles from one another in the course of mechanical agitation. The impact media is also effective in supplying randomly distributed impacts to the surfaces being plated. The impact media may be spherical or irregular, and may be metallic, ceramic, mineral, vitreous, etc. Although the impact media may be any material which is effective to achieve proper plating of the metallic particles, the media are preferably glass beads or glass cullet as described in U.S. Pat. Nos. 3,443,985 and 3,013,892. One specific advantage of glass impact media is that different sizes may be selected to obtain the appropriate penetration into concave surfaces of the metallic articles. For example, glass spheres having a specific gravity of 2.6 and a diameter in the range of from 0.010 to 0.160 inch are effective in the impact plating of number 8 screws. Other mixtures of impact media useful for treating particular metallic articles can be readily determined by one skilled in the art. In general, the volume ratio of glass beads to metal articles is in the range of from 0.5:1.0 to about 10.0:1.0.

The pH of the slurry utilized in the present invention should be maintained to below about 4, and more often the pH of the slurry is 1.5 or less. Thus the slurries of the present invention generally contain sulfuric acid, hydrochloric acid or citric acid, or mixtures thereof. When it is desired that the slurry have a pH of 1.5 or less, sulfuric acid and/or hydrochloric acid are utilized.

In one embodiment, the slurry utilized in the present invention may contain corrosion inhibitors, surfactants, or mixtures thereof. It is desirable to inhibit the corrosion of the plating metal particles by the acid to enable the particles to perform their intended plating function and also to prevent undesirable gassing for maximum smoothness of the plating. It is desirable also to include means for dispersing the metal particles and preventing or minimizing agglomeration of the solids in the slurry. Surfactants are utilized to effect such dispersions. In some instances, one compound or composition may be effective as a corrosion inhibitor and a surfactant.

Among the materials which have been utilized as corrosion inhibitors of aluminum and zinc in at least some plating solutions and slurries are amine inhibitors such as Amine O, a heterocyclic amine inhibitor from Ciba-Geigy, acetylenic inhibitors such as propargyl alcohol, butyne diol, propargyl sulfonate, etc.

Surfactants (dispersants) which can be included in the slurries of the present invention are known in the art, and these can include polyoxyethylene glycols available commercially under such trade names as "Carbowax". The Carbowax materials available from Union Carbide include polyoxyethylene glycols having molecular weights between about 2,000 to 20,000. Other examples of polyoxyethylene glycols include "Polyglycol E 50,000" from Dow Chemical Company. Other surfactants which are useful include: quaternary aliphatic ammonium salts such as "Arquad" S-2C from Armour Industrial Chemical Company; polymers having a hydrophobic polyoxypropylene terminated nucleus with a plurality of hydrophilic polyoxyethylene glycol-terminated chains attached thereto such as the "Pluronics" and "Tetronics" from Wyandotte Chemical Company; polyoxy ethylene glycol adducts of alkylphenols, especially nonylphenols such as the "Igepals" from GAF, "Tergitols" from Union Carbide; "Surfonics" from Jefferson Chemical Company, etc. Additional examples of surfactants and corrosion inhibitors which can be utilized in the slurries of the present invention are described in Golben U.S. Pat. Nos. 3,400,012 and 3,531,315. The disclosure of these patents relating to surfactants and corrosion inhibitors are hereby incorporated by reference.

The amount of corrosion inhibitor and surfactant incorporated into the slurries utilized in the present invention is related to the nature of the slurry, and in particular, the pH of the slurry and the amount of the metal particles present. In general, large volumes of liquid, open barrels, or highly acidic conditions require more inhibitor than small volumes of liquid, closed barrels or less acidic conditions. Similarly, the optimum amount of dispersant decreases as the pH rises or the weight of plating metal particles decreases.

The slurries used in the process of this invention also may contain small amounts of other inert solids such as pumice, diatomaceous earth, silica powder, pine sawdust, etc. The inert solids act as diluents for the metal powder additives and assist in cleaning the parts being plated by abrasive action.

The slurries which are utilized in the process of the present invention may be formed separately and thereafter added to the plating container or the slurry can be formed in situ by addition of the various materials to the plating container which contains the prepared substrate. The amounts of stannous salt, aluminum and zinc included in the slurry may be varied depending on various factors known to those skilled in the art. Generally the slurry will contain from 0.009 to about 0.055 percent of weight of stannous ion, from about 0.013 to about 1.5 percent of weight of aluminum powder, and from about 0.04 to about 5.0 percent of weight of zinc. Preferably the slurry will contain from about 0.033 to about 1.2 percent of weight, and more often from about 0.05 to about 1.0 percent of weight of aluminum powder. The relative amount of stannous salt included in step (c) of the invention generally is less than the relative amount added in step (d). Also, the relative amount of zinc included in step (c) generally is less than the amount included in step (d).

The slurry of the present invention is mechanically impacted against the surface of the metallic substrate, in steps (c) and (d) in a plating container to plate a codeposit of tin, aluminum and zinc on the metal surface. This step generally is referred to in the art as "impact plating". As mentioned above mechanical impacting of the slurry against the surface of the metal substrate generally is accomplished by utilizing a rotatable plating barrel or drum, and a tumbling action is obtained by rotating and, optionally, reciprocating the barrel containing the slurry and the metal articles to be plated. U.S. Pat. Nos. 3,462,691 and 3,494,327 disclose plating systems wherein the plating barrel rotates and vibrates at the same time, and such plating barrels and tumbling methods can be utilized in carrying out the process of the present invention. The process also can be carried out utilizing plating barrels which rotate but have not been modified to provide a vibrating action.

The efficiency of the plating process can be enhanced by increasing the energy input during the mechanical plating process by increasing the rotation speed of the plating barrel. Generally, surface speeds of the plating drum as defined above, will be in the range of from about 130 to over 250 surface feet per minute. In the present invention improved efficiency is achieved in one embodiment by exceeding surface speeds of 180 feet per minute and even 200 feet per minute. In cases where barrel size or rotation speeds limit the surface speed, the desired increase in energy generation can be achieved by modifying the inside of the barrel.

In one embodiment of this invention, a plating barrel is provided that is suitable for generating sufficient energy to effect the plating process of the invention. Referring to the drawings, plating barrel 10, has a cylindrical mid-section 12, a frustoconical upper end 14 and a concave circular lower end 16 co-axially aligned along center axis 18. Plating barrel 10 can be rotated in either a clockwise or counter-clockwise direction along center axis 18. Center axis 18 projects at a sufficient angle (depicted in FIG. 1 as angle A) with the horizontal to control the degree of cut or polish desired for the metal part being plated. An increase in angle A generally results in more of a cutting action, while a decrease in angle A generally results in more of a polishing action. Preferably, angle A is from about 20° to about 45°, more preferably from about 25° to about 35°, more preferably from about 27° to about 32°.

Plating barrel 10 has an outer metal shell 20, and an inner rubbery chemical-resistant lining 22 overlying the inner surface of metal shell 20. Metal shell 20 can be constructed of, for example, carbon steel and inner lining 22 can be constructed of, for example, neoprene rubber.

Figure 2:
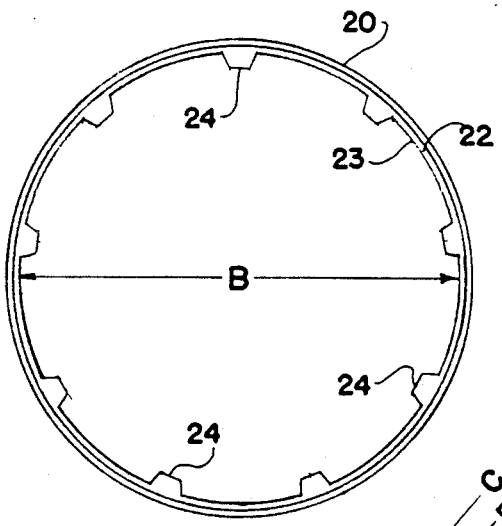
FIG. 2 is a sectional view taken along line 2—2 of FIG. 1.
Figure 3:
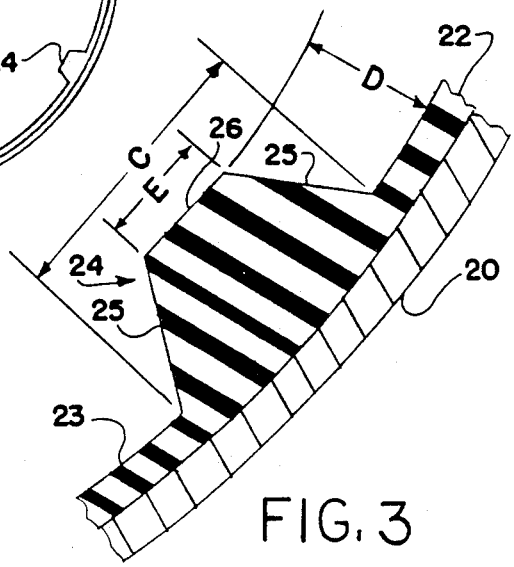
FIG. 3 is an enlarged fragmentary view of the plating barrel illustrated in FIG. 2, one of the baffles along with part of the inner lining and outer wall of said plating barrel being illustrated.

Plating barrel 10 includes a plurality of parallel spaced baffles 24 aligned along the inner surface 23 of lining 22 in cylindrical mid-section 12. Baffles 24 project radially inwardly from inner surface 23 and extend axially along the length of mid-section 12. Preferably, nine equally spaced baffles 24 are provided. Each of the baffles 24 is mounted on or formed integrally with lining 22, and has radially inwardly projecting angled sides 25 and inward-most end 26 (FIG. 3). The extent of the inward radial projection of each of baffles 24 from inner surface 23 (dimension D in FIG. 3) is preferably from about 1.5% to about 5%, more preferably from about 2.2% to about 3%, more preferably from about 2.4% to about 2.8% of the major inner diameter (dimension B in FIG. 2) of cylindrical mid-section 12. The chord length (dimension C in FIG. 3) of each of the arcs formed by the intersection between baffles 24 and inner surface 23 is preferably from about 4% to about 15%, more preferably from about 6% to about 10%, more preferably from about 7.8% to about 8.8% of the major inner diameter (dimension B in FIG. 2) of mid-section 12. The width of inward-most end 26 (dimension E in FIG. 3) is preferably from about 20% to about 60%, more preferably from about 30% to about 50%, more preferably about 40% said chord length (dimension C in FIG. 3). Baffles 24 are preferably coated with or formed from a hard rubbery or plastic material such as a high-impact strength polypropylene.

The plating barrel 10 can be mounted on any suitable rotatable apparatus by attaching mounting bracket 27 to said apparatus. Rotatable apparatus suitable for use with plating barrel 10 can be entirely conventional and such apparatus is well known in the art. An example of such apparatus is disclosed in U.S. Pat. Nos. 3,442,691 and 3,494,327, these patents being incorporated by reference herein for their disclosures of apparatus suitable for effecting the rotation of plating barrel 10. Plating barrel 10 can be is loaded and unloaded using any suitable closure means that can be mounted on end 28.

In operation, plating barrel 10 loaded with the desired metal parts to be plated and the desired plating materials, and is rotated in either a clockwise or counter clockwise direction at a sufficient rate to effect the desired plating operation. Preferably, plating barrel 10 is rotated at a rate in excess of about 130 surface feet per minute, more preferably in excess of about 180 or 200 surface feet per minute during the plating operation. The surface speeds expressed herein are measured by multiplying the diameter B (FIG. 2) of plating barrel 10 in feet times the number of revolutions per minute at which the plating barrel is rotated times 3.1416.

An advantage of the plating barrel of the invention is that sufficient energy to effect the plating process of the invention can be generated using said plating barrel even when the equipment is incapable of attaining the preferred surface speeds because of design or age. Critical features in the design of the inventive plating barrel are (1) the ratio of the length of the chord of the arc formed by the intersection of each of the baffles with the inner surface of the mid-section of the plating barrel relative to the major inner diameter of said mid-section must be within the ranges specified above, and (2) the ratio of the extent of the inward radial projection of each of the baffles relative to the major inner diameter of said mid-section must be within the ranges specified above. These critical features are necessary for the inventive plating barrel to generate sufficient energy at a lower rotation speed to effect the plating process of the invention.

The conditions under which impact plating is achieved in accordance with the process of the present invention are generally as follows. Impact plating typically is conducted at ambient temperature although impact plating may be conducted at temperatures at a range of from about 20° to about 50° C. The specific temperature will depend upon the nature of the slurry, the desired rate of plating, and the desired plating results. If thicker coatings are desired, longer periods of plating will be required.

A first essential feature of the process of the present invention involves the use of a slurry which contains tin, aluminum and zinc. Prior techniques for impact plating have utilized aluminum or zinc as driving metals, but to the inventors' knowledge, the prior art has not included any suggestion to utilize the combination of aluminum and zinc as plating metals. An unexpected result of the process of the present invention is that the metal which is plated from such slurries is found to comprise a co-deposit of tin, aluminum and zinc.

Another distinctive feature of the present invention is that the metal content of the plating slurry is renewed and replenished during the plating process by adding stannous ions, aluminum and zinc to the slurry until a co-deposit of tin, aluminum and zinc of the desired thickness is obtained. It is essential to the present invention that the stannous ions be added continually to the plating solution along with the aluminum and zinc powders. It has been discovered that the continual addition of stannous ions to the working plating slurry results in the formation of the desired co-deposit. If stannous ions are not continually added to the slurry with the aluminum and zinc, the deposit, after the initial tin deposit will not contain aluminum. In contrast, when the process of the present invention is followed, that is, stannous ions are continually added to the slurry along with the aluminum and zinc powder, the metal plating which is obtained is a co-deposit of aluminum, zinc and tin. Examination of a cross section of the co-deposit indicates that the aluminum content of the co-deposit increases from the inside of the co-deposit to the outer surface of the co-deposit, and preliminary analysis of the co-deposit indicates that this increase is from 0% aluminum internally up to about 20 or 25% aluminum at the outer surface. Analysis of the entire co-deposit indicates that the co-deposit comprises from about 80 to about 92% by weight of zinc, from about 3 to about 10% by weight of aluminum and from about 5 to about 15% by weight of tin.

The following examples (except control examples) illustrate the process of the present invention. Unless otherwise indicated in the following examples, and in the specification and claims, all parts and percentages are by weight and all temperatures are in degrees centrigrade and pressure is at or near atmospheric.

EXAMPLE 1

A 13 cubic foot round oblique tumbling mill provided with 37 energy raisers 14 inches in length, 3 inches wide and 1 inch high is charged with 400 lbs. of degreased $10\times16\times\frac{3}{4}''$ carbon steel corbo-nitrided hex-head screws. Glass impact media (300 lbs.), composed of 30% 3.5mm. diameter, 30% 1.5mm diameter, 15% 0.7mm diameter and 15% 0.25 mm diameter are added, and the plating mass is heated to a temperature of approximately 25° C. before commencing the operation. To the barrel is then added 68 fluid oz. of sulfuric acid (66° Baume), 0.7 lb. copper sulfate $\cdot 5H_2O$ and 12 fluid oz Iqepal. The barrel is rotated at 160 surface feet per minute, and after 6 minutes, 190 grams $SnSO_4$, 600 grams fine pumice, 36 grams of zinc spheres 5 to 8 micron in diameter, 12 grams of aluminum spheres about 6 to 10 microns in diameter and 30 ml. Amine O are added. Further additions of aluminum powder (5oz.) zinc (6.1 lbs ) and 150 grams $SnSO_4$ are made at 4 minute intervals 5 times. The parts remain in the rotating barrel for 15 minutes after the last addition. At the conclusion of the plating, the parts are densely coated to a thickness of 0.002", with a coating comprising approximately 87% zinc, 5% aluminum and 8% tin. Parts are very uniformly coated with 98% of all parts within plus or minus 0.0002" of the mean.

The adhesion-cohesion characteristics of the plate deposited on metal articles in accordance with the process of the present invention is evaluated in the following matter. The plate is scored with a razor blade, and the adhesion of the plate near the score is tested by applying a strip of pressure sensitive plate to the score, and the tape is then quickly removed. The amount of the plate adhering to the tape is observed and is considered to be a reflection of the adhesion properties of the plate. The results are rated from 1 to 5, being excellent adhesion (little or no plate removed by the tape), and 1 being bad adhesion (the underside of the tape containing large amounts of the removed plate. A rating of 3 is considered average and acceptable for commercial purposes. The adhesion-cohesion rating of the screws plated in Example 1 is 4.5 which is very good.

CONTROL EXAMPLE 1

The mill in Example 1 is charged as in Example 1 with the following exceptions: the aluminum is omitted, and the zinc charge is increased to 6.4 lbs. per addition. The parts are uniformly coated to a coating thickness of about 0.002", and the coating consists of about 92% zinc, 8% tin.

Corrosion testing on parts treated in accordance with the present invention (and control examples) is performed using a salt spray cabinet in accordance with the procedures of A.S.T.M. B117-37. The salt spray test is conducted on the metal parts prepared in Example 1 and Control Example 1, and the results are summarized in the following Table I. In this test, a rating of 5 indicates no corrosion and a rating of 1 indicates significant corrosion.

TABLE I

| Salt Spray Test (Hrs) | Salt Spray Test Results Ex. 1 | Ex. C-1 |
|---|---|---|
| 48 | 5 | 5 |
| 96 | 5 | 4.8 |
| 144 | 4.8 | 4.2 |
| 192 | 4.4 | 3.4 |

The results summarized in Table I demonstrate the improved corrosion resistance exhibited by metal parts plated with the co-deposit of the present invention (Example 1), particularly when compared to the corrosion inhibition results obtained when the plating contains only zinc and tin.

In addition to the A.S.T.M. B117-73 corrosion test, corrosion testing on plated nails can be evaluated by immersing a board of the nails in the Indian River in Florida and hanging the board above the river for an extended period. All nail samples are driven into a spruce board to within 0.5 inch of the head prior to the test. The samples are observed after a given period of time and rated as follows.

TABLE II

| Rating | Percent Corrosion |
|---|---|
| 5 | 0 |
| 4 | less than 5 |
| 3 | less than 20 |
| 2 | less than 50 |
| 1 | 50 or greater |

In all tests, 10 nails from each sample are tested, and an average rating is obtained by taking the mean.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

We claim:

1. A plating barrel comprising:

a cylindrical mid-section with a frustoconical upper end and a concave circular lower end co-axially aligned along a center axis, said plating barrel being rotatable about said center axis, said center axis projecting at a sufficient angle with the horizontal to provide the desired degree of cut or polish for the metal part being plated;

a plurality of parallel spaced baffles aligned along the inner surface of said cylindrical mid-section, said baffles projecting radially inwardly from said inner surface and extending axially along the length of said mid-section, the extent of said inward radial projection of said baffles being from about 1.5% to about 5% of the major inner diameter of said cylindrical mid-section, the chord length of each of the arcs aligned normal to said center axis and formed by the intersection between said baffles and said inner surface of said mid-section being from about 4% to about 15% of the major inner diameter of said mid-section.

2. The plating barrel of claim 1 wherein said center axis projects at a sufficient angle of from about 20° to about 45° with the horizontal.

3. The plating barrel of claim 1 wherein the extent of said inward radial projection of said baffles is from about 2.2% to about 3% of the major inner diameter of said cylindrical mid-section.

4. The plating barrel of claim 1 wherein the chord length of each of said arcs formed by the intersection of said baffles with said inner surface of said mid-section is from about 6% to about 10% of the major inner diameter of said mid-section.

5. The plating barrel of claim 1 with nine equally spaced baffles.

* * * * *